United States Patent [19]

Erard

[11] Patent Number: 4,461,580

[45] Date of Patent: Jul. 24, 1984

[54] WATCH, THE BACK COVER OF WHICH CONSTITUTES A PLATE

[75] Inventor: Raoul-Henri Erard, La Chaux-de-Fonds, Switzerland

[73] Assignee: Sintel S.A., La Chaux-de-Fonds, Switzerland

[21] Appl. No.: 263,019

[22] Filed: May 12, 1981

[30] Foreign Application Priority Data

May 9, 1977 [CH] Switzerland ..... 5796/77

[51] Int. Cl.³ ..... G04B 19/20

[52] U.S. Cl. ..... 368/77; 368/233

[58] Field of Search ..... 368/77, 220, 221, 233, 368/226, 322, 234, 139, 140, 145, 146, 185, 190, 206, 210, 300

[56] References Cited

U.S. PATENT DOCUMENTS

| | | | |
|---|---|---|---|
| 247,918 | 10/1881 | Jaekel | 368/234 |
| 548,008 | 10/1895 | Rebello | 368/206 |
| 1,189,055 | 6/1916 | Carlson | 368/210 |
| 2,004,280 | 6/1935 | Handley | 368/146 |
| 2,852,908 | 9/1958 | Stern et al. | 368/77 |
| 3,945,197 | 3/1976 | Erard | 368/300 |
| 4,376,996 | 3/1983 | Wuthrich | 368/220 |
| 4,382,690 | 5/1983 | Erard | 368/77 |

FOREIGN PATENT DOCUMENTS

| | | |
|---|---|---|
| 1085177 | 1/1955 | France . |
| 2229090 | 12/1974 | France . |
| 2461292 | 1/1981 | France . |

*Primary Examiner*—Vit W. Miska

*Attorney, Agent, or Firm*—Young & Thompson

[57] ABSTRACT

The back cover (51) of the watch case carries a middle-bezel and forms a plate. At its center there are superimposed and concentrically pivoted, respectively, a ratchet crown-wheel (1.6) inside which a mainspring is housed, driving a core (1.3) fast with an hour-disc (1.1) comprising a toothing on its periphery, and a transparent minute-disc (1.2) comprising also a toothing on its periphery. These discs mesh on the one hand with a drive train (2, 3, 4) by which the minute-disc is driven by the hour-disc and, on the other hand with a winding and time-setting mechanism both located outside of the discs and at least partially at the same height as these discs.

7 Claims, 14 Drawing Figures

FIG. 7a
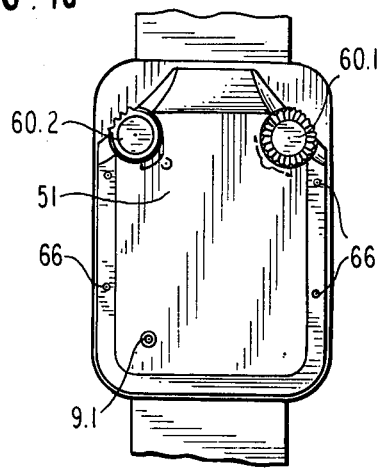
FIG. 7c
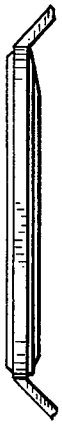
FIG. 7d
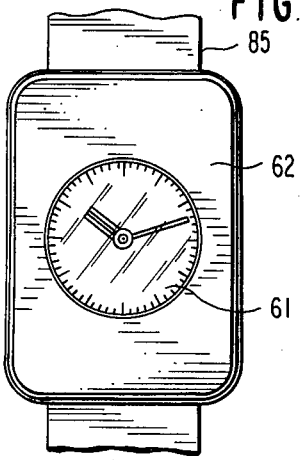
FIG. 7b
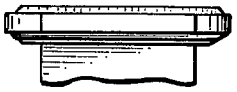
FIG. 8a
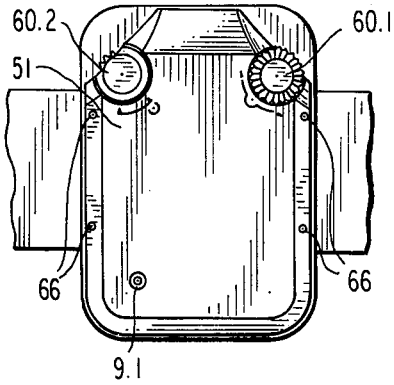
FIG. 8c
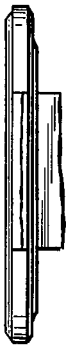
FIG. 8d
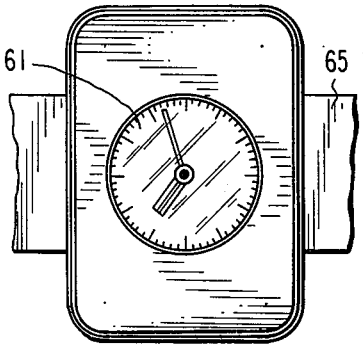
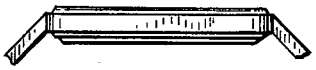
FIG. 8b

WATCH, THE BACK COVER OF WHICH CONSTITUTES A PLATE

Different kinds of watches are known, the back-cover of which constitutes at least partially a plate, the general disposition of the parts and more particularly the hand-fitting and the dial being disposed as in a conventional watch.

Watches and time pieces are also known, in which at least one time indicating member is constituted by a disc in transparent material comprising an outside toothing used for its driving through a pinion. These time pieces have relatively large dimensions in which one looks essentially for a particular effect of the display.

The object of the present invention is completely different from these known watches and provides a very high precision watch, which despite the fact that it is made out of easily machinable elements having a high reliablity, can be thinner than all the known thin watches.

To this end, the object of the invention is a watch the back-cover of the watch-case of which carries a middle-bezel and constitutes a plate on which are assembled the different elements of the movement which is characterized by the fact that it comprises firstly, below the crystal and concentrically to the axes of the hand-fitting, a minute-disc comprising a toothing on its periphery and a minute-mark, an hour-disc comprising a toothing on its periphery and an hour-mark and fast with a core driven by a mainspring located between the hour-disc and the back-cover of the watch-case; secondly, a toothed ratchet-crown, located concentrically to and below the hour-disc, within which the outer part of the mainspring is fixed so that it can be wound when the ratchet-crown is actuated one-way; thirdly, a drive train driven by the hour-disc and located beneath it and one of the wheels of which drives the minute-disc complementarily to its function in the gear-train maintaining the oscillation of the balance through the intermediary of the escapement; and fourthly, a time-setting member permitting fixing the ratchet-crown to the hour-disc to manually control its displacement during the time-setting function and that without modification of the amount of winding of the mainspring.

FIGS. 1 and 2 of the drawing are respectively, a plan view of the indicating members and of the area of the gear-train, the escapement and the balance and, a plan view of the same indicating members and of the area of the winding and time-setting mechanism, of one embodiment.

FIGS. *7a–7d* and *8a–8d* illustrate two variants of assembling and finishing, each along four distinct projections.

Figure 1:
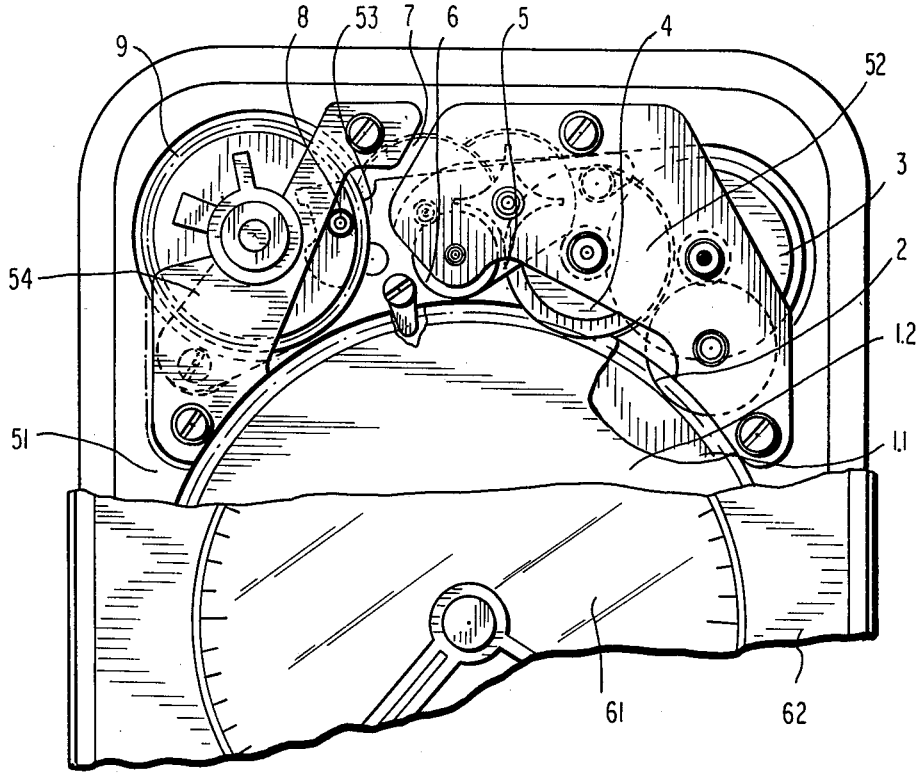
Figure 2:
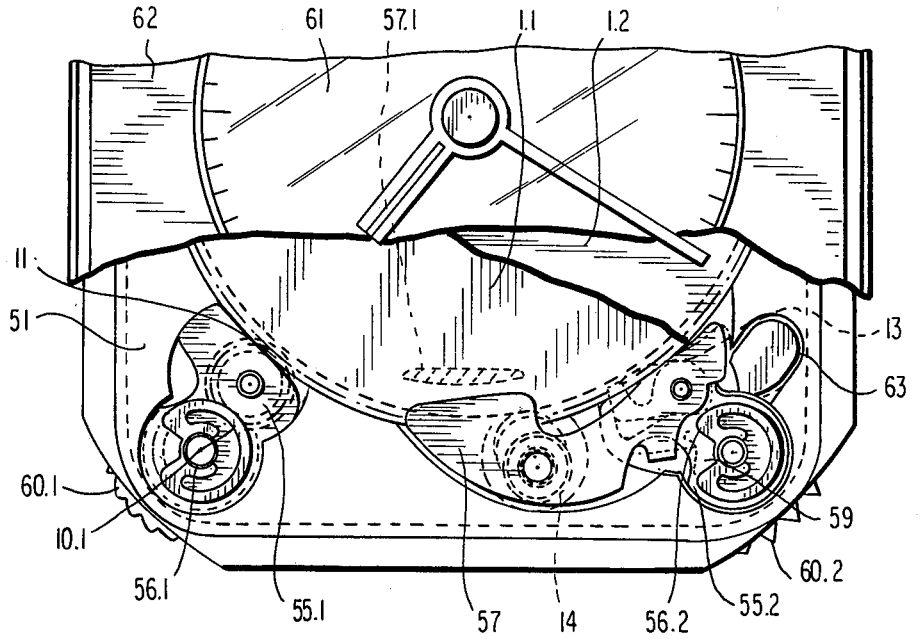

In FIGS. 1 and 2, one sees the back-cover 51 of the watch-case forming also the base-plate of the movement capped by the middle-bezel 62 carrying the crystal 61. On the inside face of the crystal, a minute-circle graduation and possibly some inscriptions such as trademarks or decoration are transferred or deposited through metallisation. The surface forming generally the dial is here constituted by the upper face of the hour-disc 1.1 which is concentric to the crystal and comprises an hour-mark thereon as well as a toothing on its periphery driving the drive train of the minute-disc 1.2. This hour-disc makes two revolutions each day under the action of a mainspring. The minute-disc 1.2 is in a transparent material, and makes one revolution each hour and comprises also a minute mark thereon as well as a toothing on its periphery used for its driving. This disc can also be realized in metal, but then it is formed of an outer ring (not visible through the crystal) connected to a central body by at least one arm forming the hour-mark and is obtained either by cutting or electroforming, this latter enabling making a disc of very small thickness as well as a very thin and narrow arm which can create a particularly esthetical appearance of the hand-setting and of the "dial".

All the elements forming the movement are located within a rectangle within which the hour display disc determines approximately an inscribed circle separating two opposed zones housing, the one (FIG. 1) the drive train, the escapement and the balance, and the other (FIG. 2) the winding and time-setting mechanism.

An intermediate wheel 2 carried by the drive train bridge 52 meshes with an intermediate pinion of the intermediate wheel 3 which meshes with the pinion of the great third-wheel 4 on the one hand and with the minute-disc 1.2, and on the other hand with the pinion of the small third-wheel 5 which meshes with the fourth-wheel pinion of the fourth-wheel 6 meshing with the escapement pinion of the escapement wheel 7 actuating the pallets 8 located under the pallets bridge 53 and maintaining the oscillations of the balance 9 located under the balance bridge 54.

The winding mechanism itself comprises a winding-button 60.1 fast with the crown-wheel 10.1 located under the mechanism plate 55.1 maintained by the pin 56.1 and meshing with a ratchet-crown 1.6 the toothing of which is identical to that of the hour-disc 1.1 under which it is located. Therefore the movement of the winding-button, manually controlled, controls the rotation of the ratchet-crown 1.6.

The time-setting button 60.2 can take two distinct angular positions, the first one selecting the winding function of the mechanism, the second one selecting the time-setting function of the mechanism.

For the winding function shown in FIG. 2 in full lines, the time setting cam 59, fast with the time-setting button which is thereby resiliently locked in this position by a beak of the rocking-bar 57, positions said latter so that the time-setting wheel 14, which is free, does not mesh with the ratchet-crown 1.6 and the hour-disc 1.1. The rocking-bar is located above the mechanism plate 55.2 maintained with the pin 56.2 and is actuated by a rocking-bar spring housed in the recess of the winding-wheel and acting in such a way that the beak of the rocking-bar pushes resiliently on the time-setting cam. The pawl 13 driven by the pawl spring 63 cooperates with the toothing of the ratchet-crown in order to permit only a one-way rotation corresponding to winding.

During the time-setting function, the angular displacement of the time-setting-button places the time-setting cam in a position controlling the displacement of the beak of the rocking-bar so that the time-setting wheel penetrates simultaneously within the toothing of the ratchet-crown and of the time-setting disc making them fast the one with the other. At the same time a special beak of the time-setting cam acts on a pawl the beak of which is freed from the toothing of the ratchet-crown which can then be displaced in either direction.

The free time-setting wheel working with the toothing of the ratchet-crown and of the hour disc compensates for the motor torque of the mainspring because it acts on the one hand on the core 1.3 fast with the hour disc 1.1, and on the other hand directly inside the ratchet-crown so that its amount of winding is a function of the displacement of one of the parts with respect to the other one. The two parts becoming fast with each other, it is then possible, by manipulating the winding-button, to displace angularly, the hour disc and the minute disc without modifying the amount of winding of the mainspring. During that operation, a part of the drive train is driven up to a wheel comprising a calibrated friction in order to slide in both directions. When the mechanism is in time-setting position, a protuberance of the rocking-bar realises a particular mark 57.1 appearing under the crystal.

Upon moving manually the time-setting button back to the winding position, through an opposite angular displacement, the time-setting wheel liberates the toothing of the ratchet-crown and of the hour-disc and the pawl limits again the rotation of the ratchet-crown in the one-way winding direction.

Depending on the kind of watch, it is possible to design variants of this mechanism, for example, by using the winding button to effect all the selection functions, the rocking-bar being then directly controlled by it.

Figure 3:
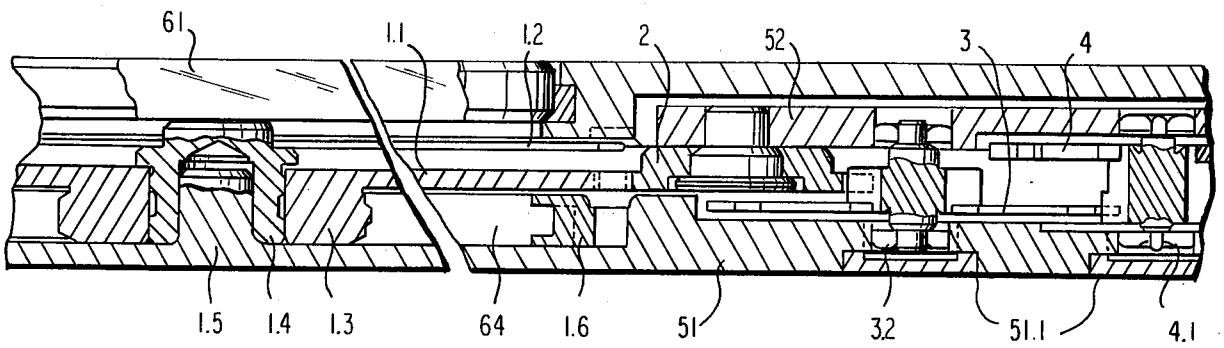
FIGS. 3 and 4 show in cross section, successively, the center of the watch with the indicating and driving members, then the gear-train, the escapement and the balance.
Figure 4:
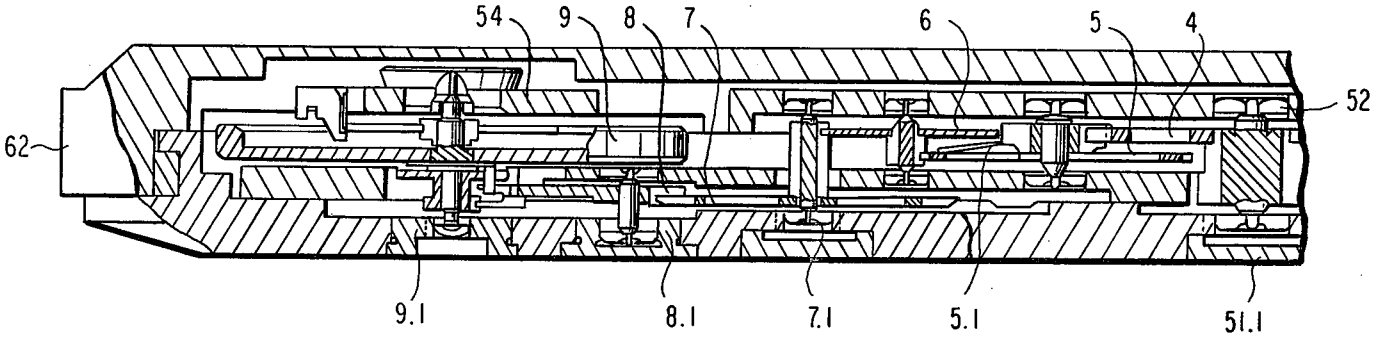

In FIGS. 3 and 4 one sees the hour-disc 1.1 fast with the core 1.3 pivoting around the center arbor 1.4 on the center stud 1.5 of the back-cover of the watch-case 51. This hour-disc is also held axially, on its periphery by means of several clamps forming also spaces wih the minute disc 1.2 in order to maintain a good parallelism with the crystal 61 carried by the middle-bezel 62. The ratchet-crown 1.6 pivots in a central recess of the case and is maintained between the hour disc and the back-cover of the case. The mainspring 64 is disposed between the hour-disc and the back-cover of the case and its outer coil is connected to the ratchet-crown, possibly through a clamp sliding when the maximum winding is reached in order not to drive the hour-disc if the torque is higher than the time-setting friction of the drive train.

It is possible to provide for seeing through a radially-extending portion of the hour-disc through which it is then easy to monitor the condition of the coils of the mainspring defining the amount of winding or the power-reserve. For example, it is possible to have the hour mark (two strokes) as a radial slot and, on a silver or gold plated disc, thereby to see the dark blue coils of the spring which, when they are wound close to the center of the hand-fitting is the sign of a maximum winding and, conversely, when they are wound in the outer zone (near the bezel opening) call the attention to the fact that the power reserve is low.

The intermediate wheel is pivoted on an intermediate stud driven in the drive train bridge 52 which carries also all the upper bearings and is, at least partially, in the same plan as the crystal. The lower bearings 3.2, 4.1, 7.1 respectively of the intermediate wheel 3, of the great third wheel 4 and of the escapement wheel 7 are driven in shaped holes (permitting the evacuation of cleaning liquids) tightly sealed with plugs 51.1 driven in the back-cover of the case made in the same material before its finishing and the decoration.

The pallets bridge carries the lower bearings of the small third wheel 5 and fourth wheel 6 as well as the upper bearing of the pallets.

The small third wheel is formed by a shaft around which a small third wheel pinion pivots freely which is fast with a friction spring the outer arms of which slide with a given torque on the small third wheel driven onto the arbor so that the assembly will be rigid during the working of the watch and that, during the time setting the small third wheel pinion will be able to turn in both directions without driving or overloading the small third wheel.

The balance bridge 54 carries the upper bearing of the balance 9 which is also located in the same plane as the crystal as well as the index-assembly.

The lower bearings of the balance 9.1 and of the pallets 8.1 are equally designed to be washable without disassembly and are also driven in a tight manner in the back-cover of the case. In the described embodiment, the conter-pivot of the balance (reinforced in thickness and tightly mounted) is visible in the back cover of the case, giving to said part a special appearance.

It is of interest to note that this type of watch permits a very easy adaptation of the running correction system, acting on the index which can be acted upon from the back cover of the case.

In the embodiment described, the fourth wheel makes one revolution in thirty seconds. One can easily provide for a window with a small crystal in the middle-bezel, centered on the longitudinal axis of the watch and located above a zone of the fourth wheel and of an aperture of the drive train bridge so as to cause to appear in said window indications or signs carried by the fourth wheel (second or running indicator).

The bridges are guided and assembled on the back cover of the case by means of guiding tubes and screws, the said tubes being driven either in dead holes of the case, or in through holes in it in the same way as the plugs or bearings.

Figure 5:
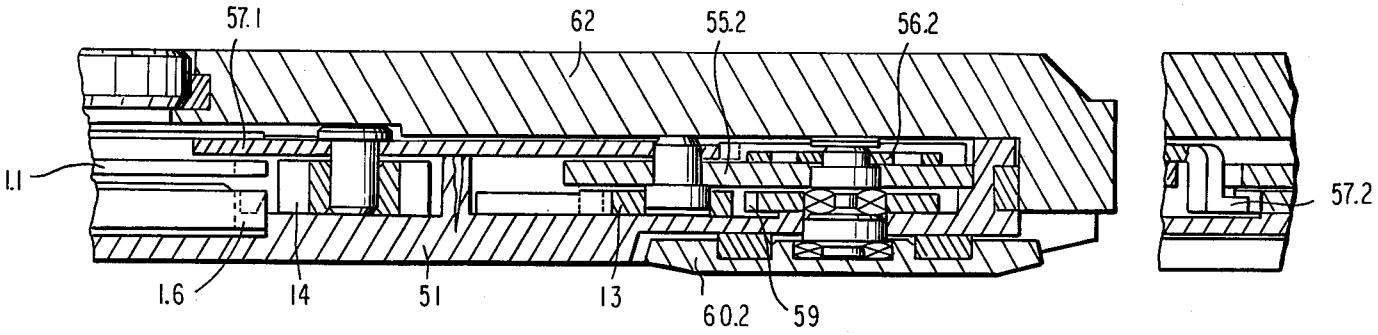
FIGS. 5 and 6 show in cross section the winding and time-setting mechanism.
Figure 6:
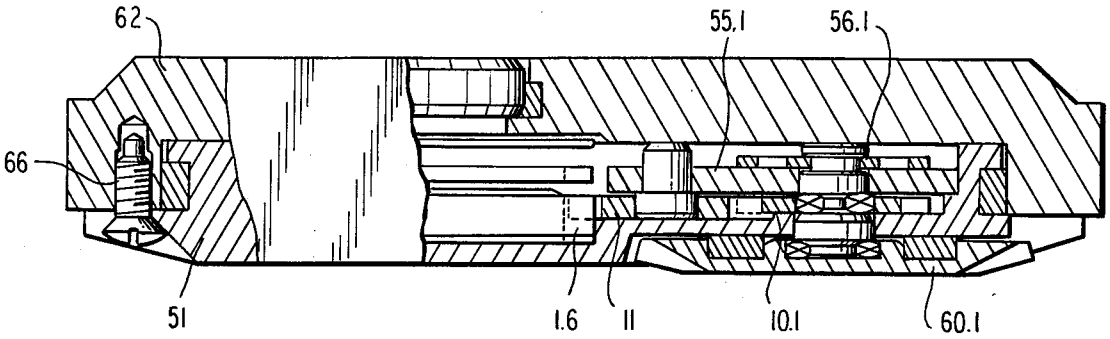

In FIGS. 5 and 6 one finds again the hour disc 1.1 and the ratchet-crown 1.6 and one sees the time setting wheel 14 pivoting freely on a stud driven in the time setting rocking bar the beak 57.2 of which cooperates with the time setting cam 59 fast with the time setting button 60.2, defining the position whereas a protuberance of the rocking bar serves as spacer and time setting mark 57.1.

The winding button 60.1 is fast with the winding wheel 10.1 which drives the ratchet-crown through the intermediary of the intermediate winding wheel 11 pivoting freely around a stud of the mechanism plate 55.1 used also as bearing for the winding rod and as abutment for the lock 56.1 maintaining it whereas the pawl 13 pivots also on a stud of an identical mechanism plate 55.2 used also as abutment for a similar pin 56.2.

This embodiment is of particular interest since it separates the control members the functions of which are easily identified and above all due to the fact that it permits the standardisation of certain parts (rods, mechanism plates, pins, joints) forming the mecahnism of low height (occupying approximately the lower half of the height of the case), and this permits using largely the middle-bezel volume located above the mechanisms for making decorative chamfers (or millings) or to incorporate complementary elements (armorial plates, initials, precious stones) without going above the upper face of the case.

In the embodiment described, the middle-bezel 62 is resiliently adjusted on the periphery of the back cover of the case through the intermediary of a tight joint and case screws 66 provide for the mounting of the assembly. According to the watch type, it is possible to reduce the middle-bezel so that it constitutes only a cover placed above the case or to use any other known mode of assembly.

The fact that the surface occupied by the winding and time-setting mechanism is less than the surface occupied by the drive train, the escapement and the balance enables to providing a case in which the crystal is eccentric with respect to the longitudinal axis of the case in the direction of the mechanism.

Finally, it is of interest to note that the embodiment described enables completely standardizing all the elements of the movement and of the case and to obtain a plurality of shapes of the watch by finishing, machining and by different dimensions of the middle-bezel and possibly of the crystal which it carries; this is particularly of interest from the manufacturing point of view as from the storing and servicing after sale point of view.

In FIG. 7 one sees the back cover of the watch 51, the middle-bezel carrying the crystal 61 and the bracelet 65 fixed in the extension of the longitudinal axis. The back-cover of the case carries an indication of the winding direction in front of the winding button 60.1 and an indication of the selection positions (winding or time-setting) in front of the time-setting button 60.2, as well as the ruby bearing of the counter pivot 9.1 of the balance bearing and the case screw 66.

In FIG. 8 one sees identically the same case but with a crystal 61 (and the hand-setting) orientated transversely of the case.

As the object of the invention relates essentially to the production of very thin watches, the particular esthetic of this kind of time piece enables a combination between the upper face of the wach and the crystal (as well as the hour disc) in order to use the total surface for the dial design, the bezel and the strap, particular facets and decorations permitting achieving a great variety of shapes independent from the rectangular base of the movement.

Furthermore, this special disposition of the movement enables achieving a watch guaranteeing good chronometric performance, having a greater power reserve than the known watches, while still being thinner.

I claim:

1. In a watch having a back cover which carries a middle bezel and constitutes a plate on which are assembled the different elements of the movement, the watch having a crystal and hands that swing about an axis, a main spring to drive the watch, and an escapement wheel whose intermittant rotation is controlled by an oscillating balance; the improvement comprising a minute disc below the crystal and concentric to said axis, the minute disc having a toothing on its periphery and a minute mark, an hour disc having a toothing on its periphery and an hour mark and fixed to a core driven by said main spring, the main spring being located between the hour disc and said back cover, a toothed ratchet crown disposed concentrically to and below the hour disc, the outer part of the main spring being fixed within the ratchet crown whereby the main spring is wound when the ratchet crown is rotated in one direction, a drive train between the hour disc and the minute disc, by which the minute disc is driven, the drive train being located beneath the hour disc, the drive train including a wheel that maintains the oscillation of the balance, and a time-setting member permitting the securement of the ratchet crown and the hour disc together to control manually the displacement of the hour disc upon setting the watch but without modification of the amount of winding of the main spring.

2. A watch as claimed in claim 1, in which all parts constituting the watch movement are situated within a rectangle inside which the hour disc defines an inscribed circle separating two opposed areas in one of which are disposed the drive train, the escapement and the balance, and in the order of which are disposed the winding and time-setting members.

3. A watch as claimed in claim 1, in which the minute disc is transparent.

4. A watch as claimed in claim 1, in which the minute disc is a ring connected to a central body by means of at least one arm forming the minute mark.

5. A watch as claimed in claim 1, in which the toothing of the hour disc and of the ratchet crown are identical.

6. A watch as claimed in claim 5, in which the time-setting member comprises a free pinion in mesh with the toothing of the hour disc and of the ratchet crown to maintain them secured to each other.

7. A watch as claimed in claim 1, in which the time-setting member comprises a particular mark appearing under the crystal when it is placed in time-setting position.

* * * * *